United States Patent [19]

Schaible

[11] 4,188,792

[45] Feb. 19, 1980

[54] METHOD AND APPARATUS FOR REGULATING A STEAM TURBINE INSTALLATION

[76] Inventor: Wolfgang Schaible, Sonnenbergstrasse 773 B, 5303 Würenlingen, Switzerland

[21] Appl. No.: 789,570

[22] Filed: Apr. 21, 1977

[30] Foreign Application Priority Data

Jan. 31, 1977 [CH] Switzerland ..... 1125/77

[51] Int. Cl.[2] ..... F01K 13/02

[52] U.S. Cl. ..... 60/660; 60/644

[58] Field of Search ..... 60/644, 660–667; 415/17; 290/40 R, 40 A, 40 B, 40 C, 52

[56] References Cited

U.S. PATENT DOCUMENTS 3,999,390 12/1976 Braytenbah ..... 60/660 X 4,096,699 6/1978 Zitelli ..... 60/660 X

*Primary Examiner*—Allen M. Ostrager

[57] ABSTRACT

A control apparatus and method for a steam turbine plant comprising supply pressure control, to be used in particular in conjunction with a turbine plant drawing its steam from a boiling water reactor, wherein there is provided rpm control with subordinated power output (rpm - power output control) and that the rate of steam flow through the turbine is controlled by reference to a continuous comparison between the controller output quantities of the supply pressure control device, on the one hand and the rpm - power output control device, on the other hand, exclusively or predominantly, as the case may be, by the smallest one, in terms of rate of steam flow, of said controller output quantities (minimum value selection).

41 Claims, 7 Drawing Figures

METHOD AND APPARATUS FOR REGULATING A STEAM TURBINE INSTALLATION

BACKGROUND OF THE INVENTION

The present invention concerns a control method for a steam turbine plant comprising supply pressure control, the method to be used in particular in conjunction with a turbine plant drawing its steam from a boiling water reactor. The invention further concerns control apparatus for performing the method, to be used in conjunction with a steam turbine plant, comprising a supply pressure control device and a bypass valve system, as well as a control valve system for controlling the rate of steam flow through the turbine.

The control of the supply pressure, i.e. the pressure control of the supply steam before it reaches the turbine, offers advantages primarily in the steady state operation at essentially constant load and represents the usual mode of operation, in particular in the case of turbine plants having as its steam generator a boiling water reactor. The boiling water reactor is here mentioned as an example of a steam generator operating by way of a simply closed circuit of steam supplied directly to the turbine, wherein the rate of its recirculated steam flow should be held constant during normal operation. Such a supply pressure control device is not suitable for handling the rapid load changes arising in the usual steam turbine plants with electrical generators. In the case of a boiling water reactor or a steam generator similar to the one mentioned before, the supply pressure and the flow rate of recirculated steam is maintained by means of a bypass-valve system, which, in case of load decreases, carries the excess steam to the condenser, by bypassing the turbine.

On the other hand, steam turbine plants with conventional steam generators, whose rate of steam flow and supply pressure can be controlled with comparatively little delay times and adjusted to changing operating conditions, are usually operated by means of the well known rpm-power output control device, i.e. with an rpm-control device comprising a subordinated power output control device. This generally known control system is characterized in its steady state operation by curve characteristic lines of rpm versus power output influenced by two parameters, namely by the slope of the line, which corresponds to the static setting, and the rpm at a predetermined reference power output, as for instance at no load or at rated load. In the "steady state" control state the operating point determined by the two control quantities "rpm" and "power output" lies on the appropriate characteristic line, not considering a possible remaining control deviation, which might occur in the case of proportional control; however, the location of a transient operating point on the characteristic line is determined by the effective disturbances of rpm, frequency or load. In the limiting cases of impressed rmp (generator connected to a network of constant frequency), on the one hand, and of impressed load, on the other, the turbine power output and the turbine rpm corresponding to a specific pair of parameters establishing the characteristic line are forcibly determined. To keep the rpm constant thus requires, in general, an adjustment of the characteristic line parameters, generally of the rpm at no-load or rated load (frequency control).

The rpm-power output control and the frequency-power output control are basically suitable for handling the various operational states occurring in practice and in particular the changes in load; however, their characteristics are not necessarily in harmony with the realities of a supply pressure control.

SUMMARY OF THE INVENTION

The problem to be solved by the invention is therefore, to create a control method and apparatus, which provide in combination a supply pressure control with an rpm-power output control, while taking into account the changing operating conditions of the steam turbine plant.

According to the invention, the solution to this problem consists in a control method comprising supply pressure control, as mentioned above, there being provided rpm control with subordinated power output control (rpm-power output control), the rate of steam flow through the turbine being controlled by reference to a continuous comparison between the controller output quantities of the supply pressure control device, on the one hand, and the rpm-power output control device, on the other hand, exclusively or predominantly, as the case may be, by the smallest one, in terms of rate of steam flow, of said controller output quantities (minimum value selection).

The solution to the problem posed for a control apparatus of the kind mentioned at the outset is characterized in that an rpm-control device comprising a subordinated power output control device (rpm-power control device) is provided, that the input of at least one control channel of the control valve system is connected to the output of a comparing and switching device, which, in turn, is connected at its input side to at least one controller output of the supply pressure control device and at least one output of the rpm-power output control device (RnP), and that the output of the comparing and switching device is in exclusive or predominant control connection with the smallest one, in terms of valve setting, of its input signals (minimum value selection).

In an operating state under dominant control of the supply pressure control device it would be possible to have the controller output quantity of the rpm-power output device to be continuously supplied into the minimum value selection process. However, a further development of the invention provides, that in dependence of the result of a comparison between the controller output quantities of the supply pressure control device and the rpm-power output control device, subsequent to a change to controlling the rate of steam flow through the turbine by the supply pressure control device a substitute signal of predetermined magnitude may be introduced in place of the controller output quantity of the rpm-power output control device into the comparison between the controller output quantities of the supply pressure control device and the rpm-power output control device, i.e. into the minimum value selection process, said substitute signal being again replaced by the controller output quantity of the rpm-power output control device only in case of a drop in the power output of the turbine. This method of operation presents the advantage, that any small disturbance which may arise in the rpm-power output control process during steady state operation at maximum rate of steam flow and would lead to unnecessary interference into the minimum value selection process and thereby to an unnecessary drop in power output, remains ineffective and can be alleviated without any disturbance in the operation.

Furthermore, according to a special embodiment of the invention it is of advantage, subsequent to changing to controlling the rate of steam flow through the turbine by means of the supply pressure control device, to increase the controller output quantity of the rpm-power output control device to a value, which is higher by a predetermined amount than the controller output quantity of the supply pressure control device and to make it assume again a value determined by the actual difference between desired and actual values of the rpm-power output control device only in case of a drop in turbine power output. In this way, it is possible to avoid the switching back and forth of the minimum value selector in consequence of samll fluctuations of operational quantities in the changeover range.

The reintroduction of the controller output quantity of the rpm-power output control device into the minimum value selection process, i.e. the changing of said controller output quantity to a value determined by the actual difference between desired and actual values, can be automatically performed in dependence upon various criteria. One particular embodiment of the invention provides an changeover criterion the occurrence of a disturbance in an operational state, in which the rate of steam flow through the turbine is controlled by the supply pressure control device, said disturbance being in particular, the exceeding of a predetermined limit value of the rotational speed (rpm) and/or of the rotational acceleration of the turbine. According to another embodiment of the invention, the frequency in the load circuit of an electric-generator coupled to the turbine is subjected to at least one comparison test against a limit or threshold value, and the exceeding of said limit value is used as a changeover criterion in the previously mentioned sense. Another changeover criterion of practical significance could be the detection of a load rejection in the load circuit of the generator, in conjunction with exceeding a limit value of the rotational acceleration.

Furthermore, in some cases it has proven to be of advantage to compare the difference between desired and actual values of the rpm-power output control device, without prejudice to a possible disconnection of the corresponding controller output quantity from the minimum value selector in the sense of the above described embodiments, with at least one predetermined limit or threshold value, and to use the exceeding of said predetermined limit of the absolute value of the difference between desired and actual values, in the direction of a too large actual value of the power output, as a changeover criterion for the reactivation of the minimum value selection and for using the actual difference between desired and actual values of the rpm-power output control device for the purpose of this selection.

Finally, the reactivation of the minimum value selection can be performed automatically in dependence on a quick-shutoff of the turbine, which is triggered for turbine protection. In the case of quick-shutoff said reactivation of the minimum value selection is performed by means of a substitute quick-shutoff positioning quantity, which is impressed at the input of the minimum value selector, in dependence of appropriate criteria and which impresses at the output of the minimum value selector a closing signal for the control valve system and implements, with correspondingly little delay, the opening of the bypass valve system by way of the differencing control device for the rate of steam flow. In this way, it is feasible to keep the recirculated steam flow rate constant, without having to wait for a change in the control deviation of pressure.

It should be noted that the above mentioned changeover criteria for the reactivation of the minimum value selection by using the actual difference between desired and actual values of the rpm-power output control device or the substitute quick-shutoff positioning quantity are applicable depending on the prevailing conditions of the individual application, singularly, in various combinations, or in their total combination. In this way, it is possible to achieve for a large range of varying operational requirements a large degree of availability and safety from breakdowns of the overall plant without limitations in regard to safety against dangerous and potentially damaging operational states.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Let it be stated in advance, that the reference symbols for the output signals of the functional units, if they are not provided with their own special symbols, are considered for the sake of simplicity, to be the same as the reference symbols for the functional units themselves or their outputs, if these outputs have no reference symbols. General functional symbols are sometimes provided within the unit, such as Σ for summing members, PI for members having a proportional-integrating transfer function, PID for members having a proportion-integrating-differentiating transfer function, 3/1 for concentrating members or members computing averages disposed between three-channel and one-channel transfer sections, and E/H for electrohydraulic transducers. Furthermore, simplified transfer diagrams are shown inside the units, when needed (e.g. output signal plotted on the ordinate, against input signal plotted on the abscissa).

Figure 1:
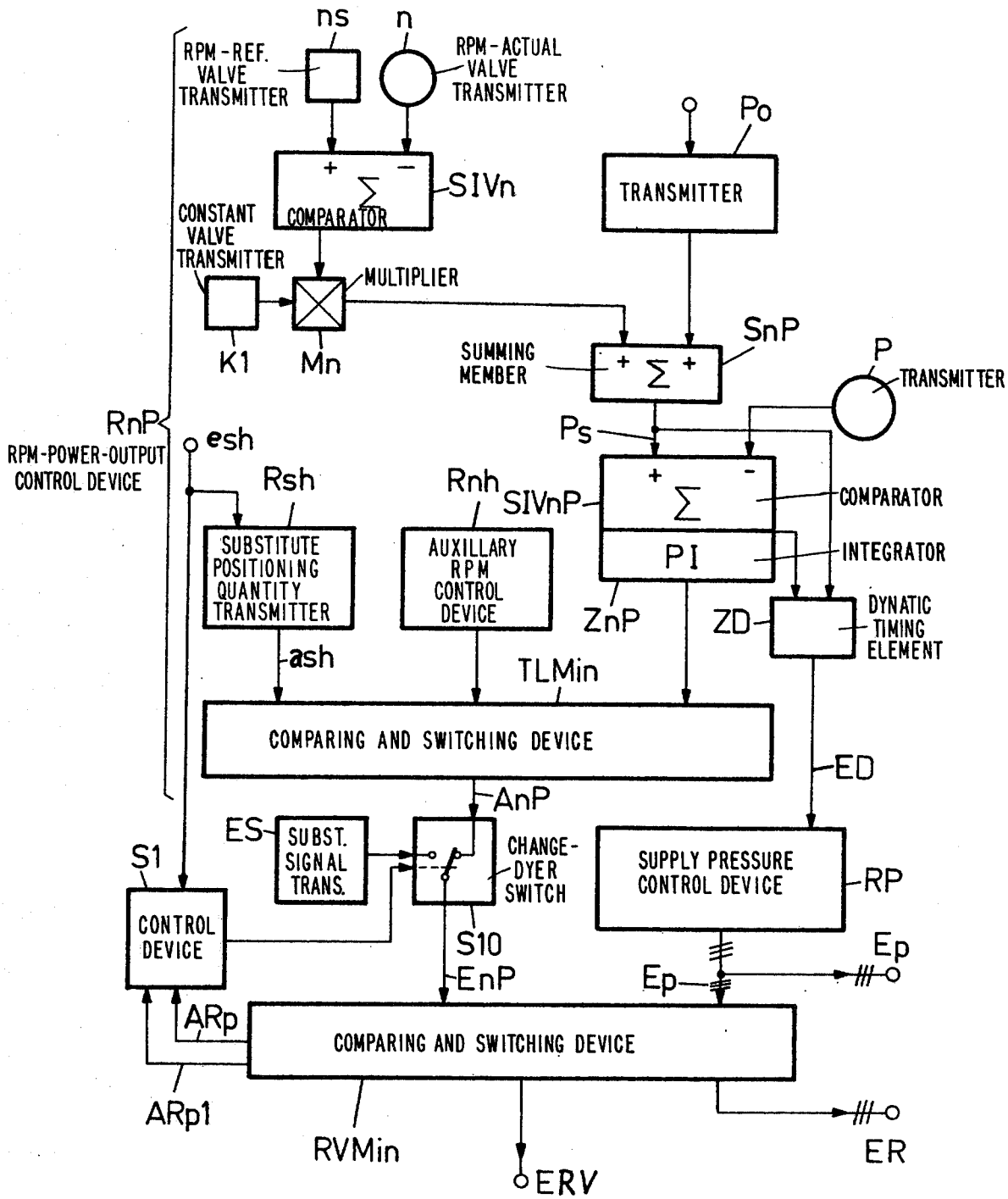
FIG. 1 is a block diagram of a first part of a control apparatus for a steam turbine, comprising an rpm-power output control device or regulator and a supply pressure control device or regulator.
Figure 2:
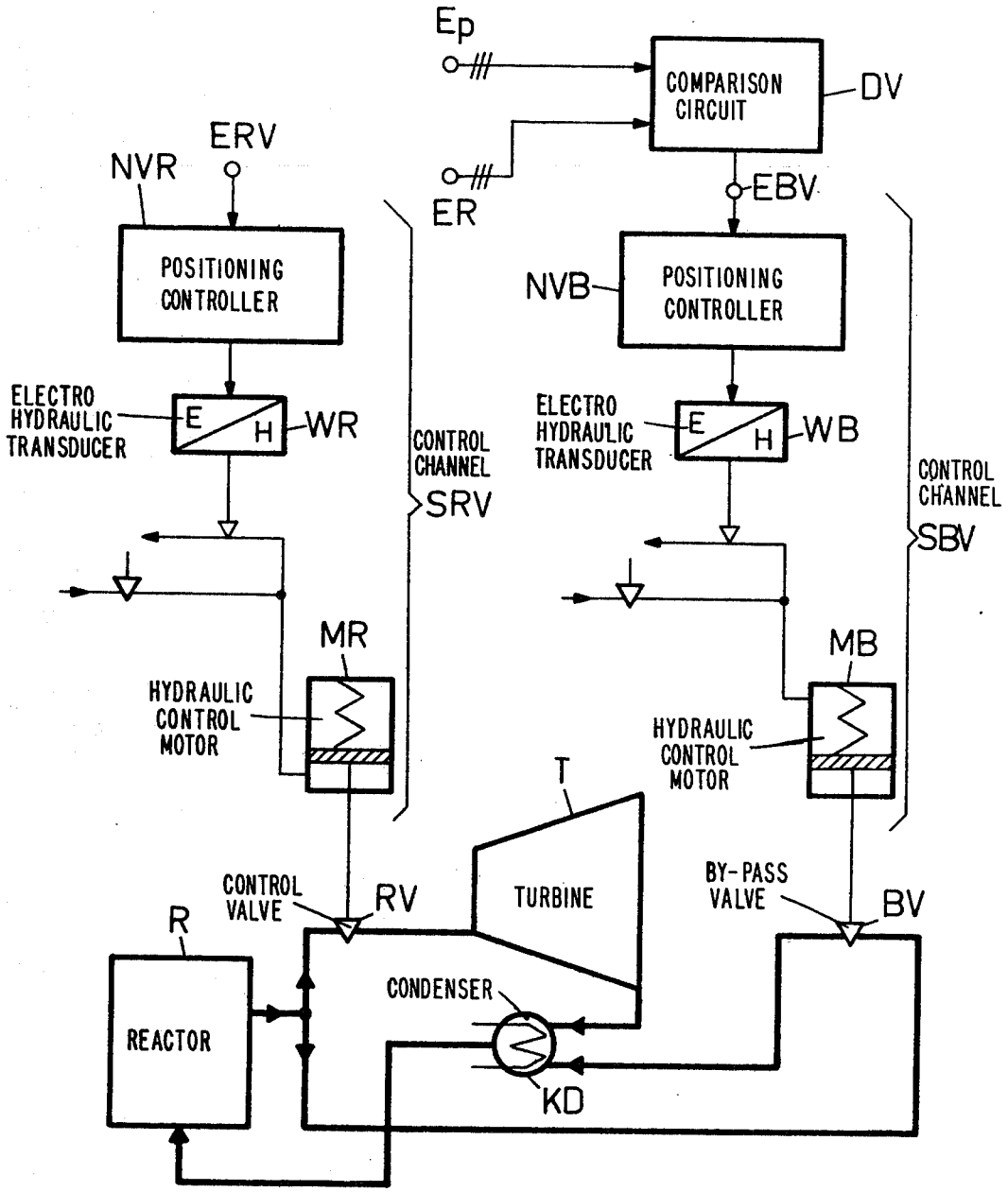
FIG. 2 is a block diagram of a second part of the control apparatus, comprising a device for controlling the flow rate of recirculated steam, a control valve system and a bypass valve system.

FIGS. 1 and 2 provide an overall view of the entire control apparatus in the form of a block diagram to be considered as interconnected, the connection between the two parts of the apparatus or devices being established by means of the connections ERV, ER and Ep to be elaborated on later in detail. FIG. 1 essentially comprises the rpm-power output control device or regulator RnP and the supply pressure control device or regulator RP, as well as the comparing and switching device RVMin, which connects the two; FIG. 2, in turn, shows the schematically drawn reactor R as steam generator, the tubine K with the condenser KD the control valve system RV and the bypass valve system BV, each with its control channel SRV and SBV, respectively, and a comparing or comparison circuit DV for keeping the flow rate of recirculated steam constant. Between the reactor R and the condenser KD there are disposed the flow channels across the turbine T comprising the control valve system RV, on the one hand, and the bypass valve system BV, on the other, connected in parallel. The rate of recirculated steam flow determined by the prevailing operational state of the reactor thus corresponds to the sum of the partial flow rates through valve systems RV and BV.

Within the rpm-power output control device RnP there is provided a device SIVn for comparing desired or reference values with actual values and for forming an rpm-dependent positioning or adjustment quantity, said device being connected by way of opposing inputs with an rpm-desired or reference value transmitter ns and an rpm-actual value transmitter n.

The difference between reference or desired values and actual values at the output of the comparison device or comparator SIVn is weighted within a multiplying device or multiplier Mn with a factor derived from a constant value transmitter K1 and superimposed within a subsequent summing member SnP upon a desired reference power output value derived from an appropriate transmitter Po. This reference value corresponds to an actual power output value only for a specific rpm value, namely the reference rpm value, while assuming the role of parameter in the steady state characteristic line (rpm versus output), and determining its position in regards to height. On the other hand, the weighting factor K1 of the rpm control deviation determines, as parameter, the slope of the characteristic line, i.e. the steady state rpm characteristic. The effective and rpm-dependent desired output value Ps appears at the output of the summing member SnP and is delivered, together with a desired or reference output value P from an appropriate transmitter, to opposing inputs of a comparison device SIVnP for comparing desired or reference values and actual values of the resulting rpm-power output control device. A proportional-integrating member ZnP connected after said comparison or comparing device SIVnP converts the resulting difference between reference or desired power output and actual power output into a positioning quantity with appropriate timing behaviour, and thus provides the controller or regulator with a transfer function having an integrating component. This provides the possibility of a control or regulation without any deviation of the steady state rpm-power output characteristic line, under steady state balanced conditions of the controller or regulator.

An auxiliary rpm control device Rnh is, furthermore, provided for the purpose of starting up the turbine plant and a substitute positioning quantity transmitter Rsh is provided for the purpose of a rapid opening of the bypass valve system in case of turbine quick-shutoff. The required activation of the output signal of only one of the aforementioned units SIVnP/P1 or Rnh or Rsh is taken care of by way of a minimum selection process within a comparing and switching device TLMin, which permits only the smallest of its input signals, in terms of the valve setting, to pass to its output AnP. This minimum selection process can be performed with circuits of known kinds, which do not here require any further elaboration. The comparing and switching device TLMin represents in actual practice a turbine leading or control station, whose output AnP carries during normal operation the resulting positioning quantity of the rpm-power output control device. The output signal AnP arrives by way of a changeover or reversing switch S10 to be elaborated upon in the following, together with its control circuitry, at an input EnP, associated with the rpm-power output control, of the aforementioned comparing and switching device RVMin, which is connected by way of a second, three channel input Ep to the output of the supply pressure control device RP, which also has been mentioned before. The supply pressure control device RP is constructed, for reasons of safety, with three channels, in a manner to be yet explained more fully, whereby the various control or regulating channels which initially have equal importance within the comparing and switching device, are concentrated in an averaging process to a resulting positioning quantity offering high safety against breakdown. As a result of the minimum value selection taking place in the comparing and switching device RVMin, the smallest of the input signals, in terms of the valve setting, that is, of the output value of the rpm-power output control device at AnP and EnP, respectively, on the one hand, and the output value of the supply pressure control device at Ep, on the other hand, is allowed to pass to the output of RVMin. This output is identical with the input ERV of the control channel SRV of the control valve system RV shown in FIG. 2.

The control channels SRV and SBV, shown in FIG. 2 of the control valve system and bypass valve system, respectively, are constructed in similar fashion and each comprise, starting out from their inputs ERV and EBV, respectively, one positioning controller, NVR and NVB, respectively, with subsequent electro-hydraulic transducers WR and WB, respectively, and hydraulic control motors MR and MB respectively. The input EBV of the bypass valve control system is connected to the output of the comparing or comparison circuit DV, whose three channel inputs Ep and ER are connected to appropriate terminals of RVMin according to the showing of FIG. 1 and are concentrated by means of an averaging device contained within the comparison circuit or unit DV.

Additional characteristics and circuitry details of the control apparatus are explained with reference to the following description of functions.

During the pressure buildup following the startup of the reactor R, the control valve system first remains closed, due to the fact, that the output signal of the rpm-power output control device RnP, held at a lowest value and being dominant over the minimum value selector, holds the input ERV of the control channel SRV of the control valve RV at closing level. At the same time, the reference or desired value of the supply pressure control device RP is raised, corresponding to the startup of the reactor R, and produces at the terminal Ep an appropriate pressure positioning quantity.

The terminal ER located on the output side, considered with regard to the comparing and switching device RVMin, carries the same signal as the output ERV, however, as shown in FIG. 1, through three channels. Thus, between the terminals Ep and ER there lies the difference across the minimum value selector, i.e. in the prevailing operational condition essentially the positioning quantity for adjusting the valve setting required for generating the desired pressure value. A corresponding difference signal is produced in the comparing device DV connected at its input side to the terminals Ep and ER, which, in turn, controls the bypass valve system BV by way of input EBV and control channel SBV, and sets it in its open position. Thus, the bypass receives the recirculating steam corresponding to the instantaneous desired or reference pressure value and reactor condition.

As soon as the conditions for the startup of the turbo-generator group (turbine with generator) are fulfilled, the auxiliary rpm-control device Rnh assumes control over the control valve system RV with a correspondingly increasing desired or reference value. Since the output quantity of the rpm-power output control device RnP is larger than that of the auxiliary control device Rnh, it is only the output quantity of such auxiliary control device Rnh which reaches the output AnP, and thus the input EnP of the second comparing and switching device RVMin. Only this input or input value is permitted by the minimum selector within comparing and switching device RVMin to pass to the control input ERV, because the output quantity of the supply pressure control device Rp is still the larger one. After raising the turbine rpm to synchronous speed, the auxiliary rpm-control device Rnh is disconnected from synchronization, and the output quantity of the rpm-power output control device RnP, returned under the sole action of the difference between reference or desired and actual values of the power output, takes over the command by way of comparing and switching device TLMin and comparing and switching device RVMin, at first in accordance with a no-load or low load operation, at small valve setting of the control valve system.

The three channel terminal ER of comparing and switching device RVMin, in turn, carries in the aforementioned accelerating operational states the positioning quantity for the control valve RV, which at present is different from zero, so that the comparing or comparison circuit DV provides at its output side only a bypass valve control signal corresponding to the difference between the positioning quantity for the control valve and the positioning quantity for the supply pressure, i.e. a control quantity corresponding to the difference between the rate of steam flow through the turbine and the rate of recirculated steam flow. This last quantity determines, in turn, the valve setting of the bypass valve system BV, so that the latter carries off exactly the rate of steam flow required for maintaining the predetermined rate of flow to be recirculated. This applies also to the subsequent load-takeover by the turbo-generator group, the command being exercised by the Po-unit at increasing desired power output reference values. This operational range extends up to an output quantity of the rpm-power output control device, which is equal to the output quantity of the supply pressure control device, i.e. to the signal of one of the output channels of this control device. At the same time the bypass valve system is controlled in opposite sense to the control valve system. With increasing valve opening or setting of the control valve system and increasing power output, the bypass valve system BV is progressively closed, until it is completely closed in the condition of the aforementioned equality of the positioning or adjustment quantities. The entire rate of recirculated steam is then taken over by the turbine, by way of the control valve system RV.

Figure 3:
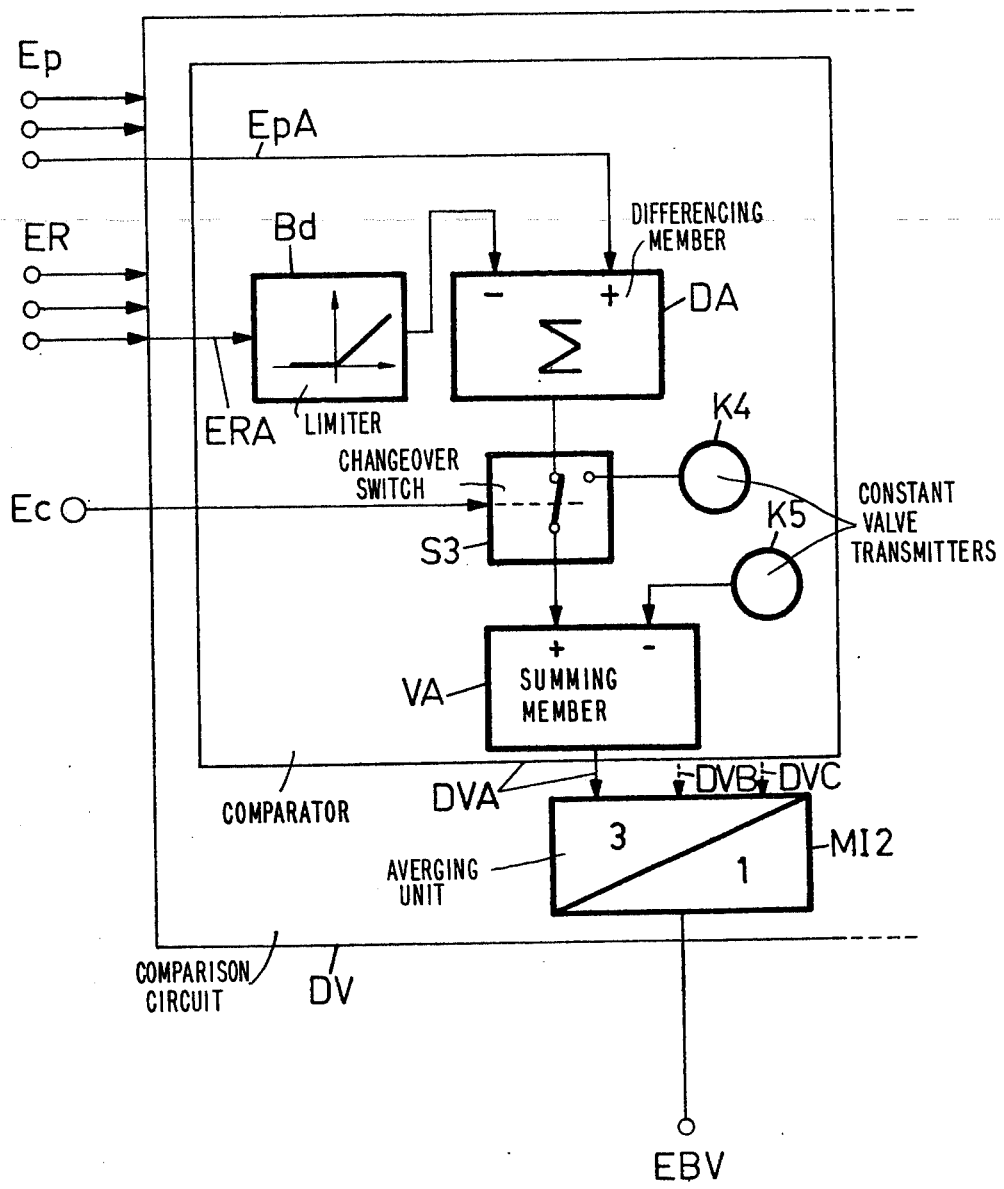
FIG. 3 is a functional diagram of the device according to FIG. 2 for controlling the flow rate of recirculated steam.

The construction of the comparing or comparison circuit DV, constituting an essential circuit component of the above explained difference-bypass control system, is shown in detail in FIG. 3. Corresponding to the three channel inputs Ep and ER, the circuit comprises three comparing units or comparators DVA, DVB and DVC, of which only the first is shown in detail. The input ERA of this comparing unit or comparator DVA leads to a limiter Bd, which keeps away from the process of forming the difference between supply pressure and control valve positioning quantities, any negative control valve positioning quantity, which is generally supplied before turbine startup for closing safety, (bias) and which would displace the point of activation of the difference control system. Then follows the comparison proper of the positioning quantities within a differencing member DA, connected with opposing inputs to the input EpA and the output of the limited unit Bd. A subsequent changeover or reversing switch S3 makes possible in certain operational states requiring a rigidly predetermined bypass valve setting a switchover from the output of the differencing member DA to a constant value transmitter K4. This switchover can be controlled by way of a corresponding input Ec. There follows a summing member VA with a further constant value transmitter K5, by means of which it is possible to presupply the bypass valve system with closing safety (bias). The outputs of the three comparing units are eventually concentrated within an averaging unit or mean valve former M12, the output of which corresponds to the control input EBV of the bypass valve system.

In the operational state, in which the rpm-power output control device RnP is dominant, it is possible to make the turbine plant conform to the changes in power output ranging from startup, through low load operation, up to full load, by rapid control, without affecting the supply pressure control, because the bypass valve system is adjusted, with only little delay, in opposing sense relative to the control valve system. Such rapid power output changes occur, for example, in case of frequency changes in the load circuit of the turbo-generator. During load drops the bypass accepts the increased excess, whereas the bypass steam flow represents a rapidly available dynamic power output reserve for rapid load increases.

On the other hand, for any rapid load increase there is, under circumstances, permissable and desirable an equal increase of the supply pressure. For this purpose, there is an additional control connection provided between the rpm-power output control device RnP and the supply pressure control device RP, as shown in FIG. 1 and explained in detail further below, namely by way of a dynamic time member or timing element ZD, which possesses a transfer function with a differentiating component and by corresponding transfer behaviour supplies a correction signal of opposite sense relative to the difference between reference or desired and actual values of the rpm-power output control device (assuming the proper adoption of signs). Thus, for example, a rapid increase of the desired power output value produces, by way of said dynamic correction signal, a drop in the desired or reference pressure value and a resulting increase in the valve setting of the control valve system.

Figure 4:
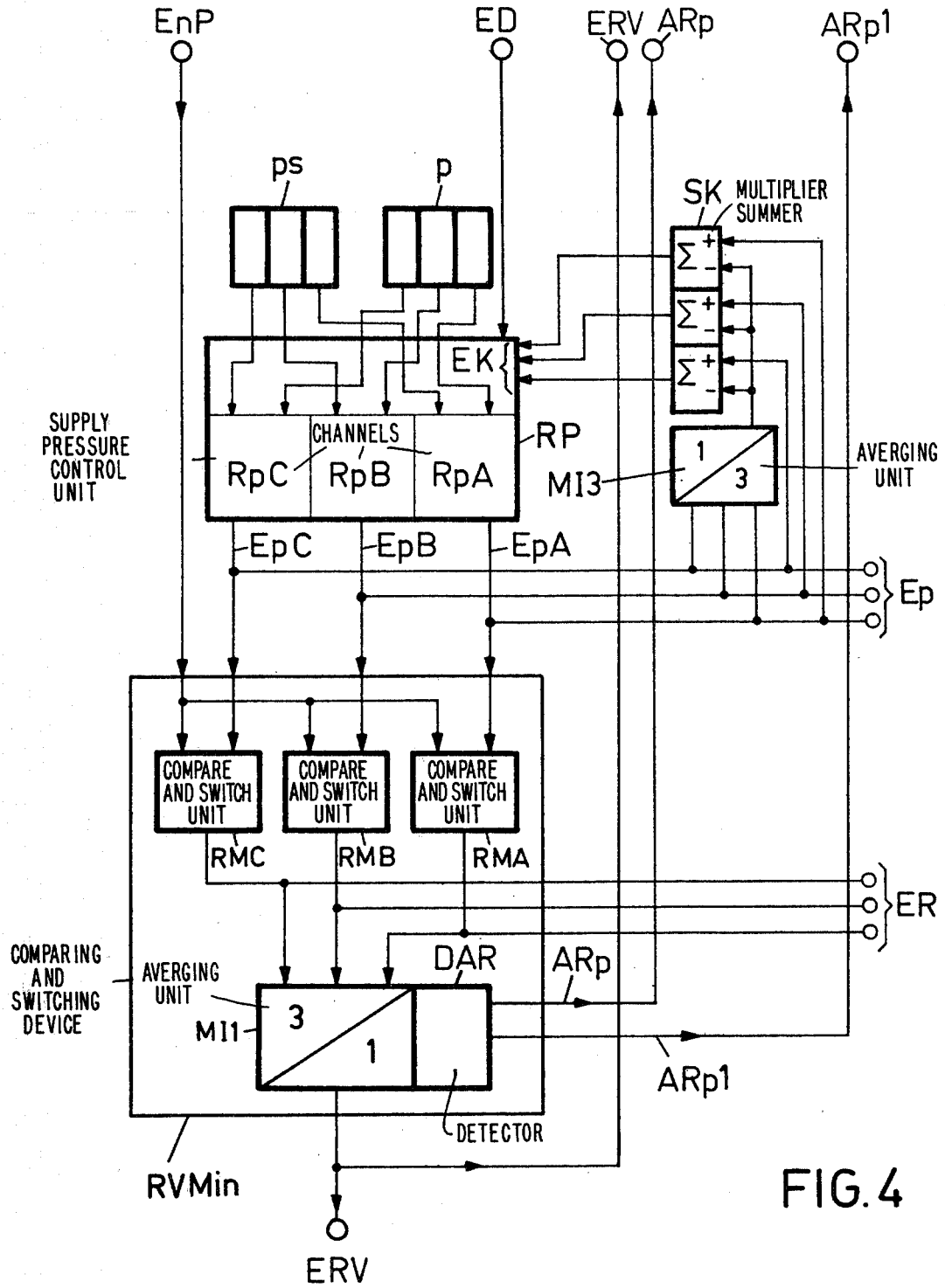
FIG. 4 is a block diagram of the supply pressure control device comprising minimum value selection, according to FIG. 1, shown in detail.

In the following, the assumption of command by the supply pressure control device during full load operation is explained in detail, with reference to FIGS. 1 and 4.

As mentioned before, the supply pressure control device RP comprises several channels, in the particular example shown, three channels. These are indicated in the block diagram of FIG. 4 as channels RpA, RpB and RpC. Each channel comprises a controller, complete with desired or reference value transmitter, actual value transmitter and comparing device for desired or reference and actual values. These transmitters are schematically shown in FIG. 4 in condensed form, as three-channel units ps and p. Accordingly, the subsequent comparing and switching device RVMin is provided with three comparing and switching units RMA, RMB, RMC connected to its three-channel input Ep, each of said units being connected at its input side firstly with the common input EnP of the rpm-power output control device RnP and secondly with one respective output EpA, EpB and EpC of the supply pressure control channels RpA, RpB and RpC, respectively. A separate minimum value selection is performed for each of said channels, the corresponding resulting signals being conducted to the three-channel terminal ER already mentioned before they are concentrated in an averaging unit or mean value former M11. In addition, there is provided a detector DAR, which generates at an output ARp a switching command, provided that all three channels of the supply pressure controller or control device RP carry results of the minimum value selection, smaller than the output quantity of the rpm-power output control device RnP appearing at the input EnP. A control circuit S1 of the changeover switch S10 is thereby influenced, as may be seen in FIG. 1, so that the latter switches over the input EnP from the output AnP of the rpm-power output control device RnP to a substitute signal transmitter ES. The substitute signal is predetermined in magnitude in such a way, that, in terms of valve setting, it lies above full load value, and at all times above the controller output quantity of the supply pressure control device RP, so that the rpm-power output control device RnP cannot forthwith intervene in the minimum value selection. However, the switchover automatically takes place, i.e. is triggered, depending on predetermined conditions, in particular on the occurrence of certain disturbances.

The supply pressure control device RP comprises, in addition to the input ED already mentioned, a three-channel correction input EK, which serves the purpose of equalizing the three controller channels among themselves, in a way to be yet further elaborated on. This is advisable in particular when using controllers comprising an integrating part, so as to prevent the individual positioning quantities from diverging. The correction signals are formed as the difference of the appropriate positioning quantity at the controller outputs EpA, EpB, EpC, on the one hand, and the average value of these output quantities, on the other. An averaging unit or mean value former M13 is provided for this purpose, the output signal of which is carried, together with the aforementioned controller output signals, to corresponding opposing inputs of a multiple summing member SK. The outputs of the latter form said three-channel input EK.

Figure 5:
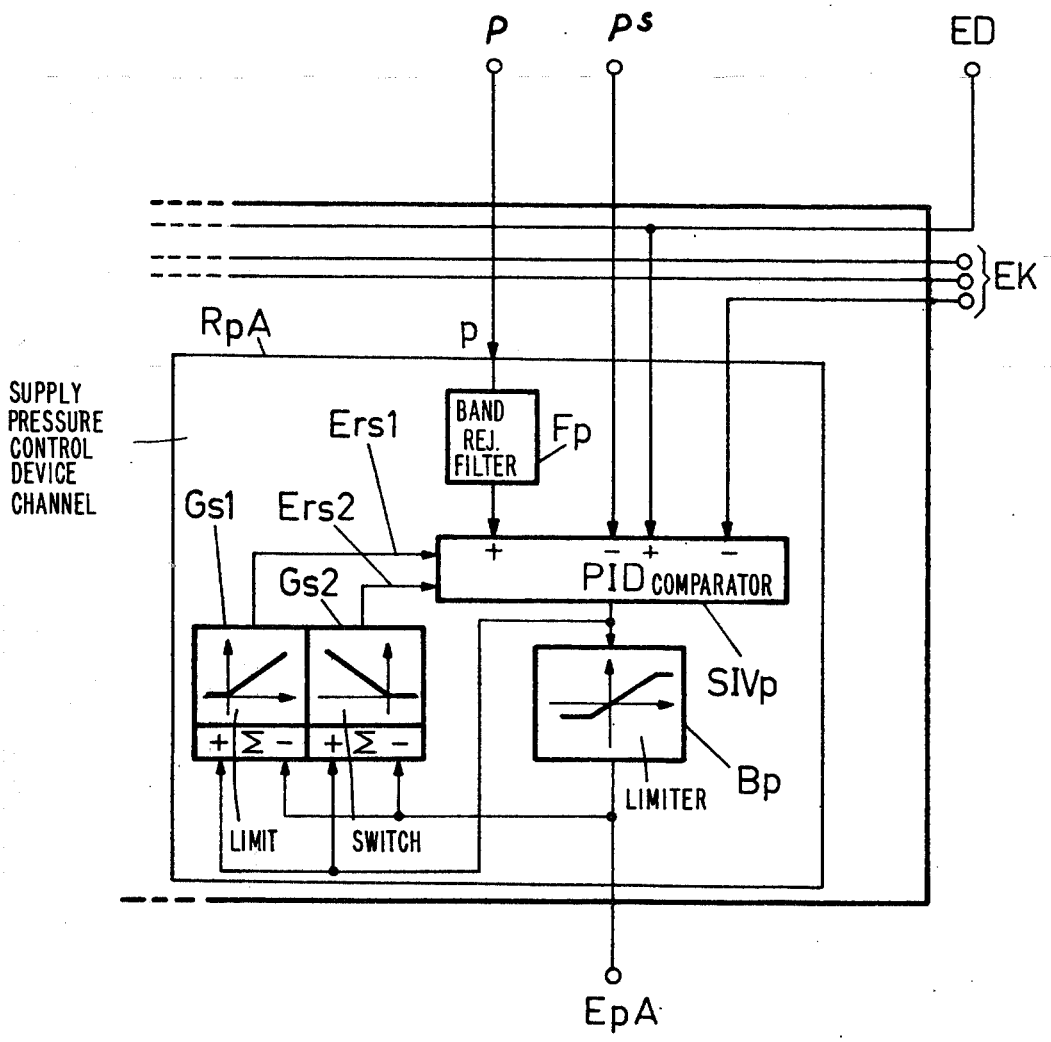
FIG. 5 is a functional diagram of the desired pressure value transmitter comprising a single-channel pressure control unit within the supply pressure control device of FIG. 4.

The detailed construction of the supply pressure control device is illustrated in FIG. 5, in which only channel RpA is shown.

A main component of the controller channel RpA is a device SIVp comparing desired or reference values with actual values, said device possessing a PID transfer function and opposing inputs for the desired or reference value ps and the acutal value p, respectively. The latter is carried through a band-rejection filter Fp, for the purpose of suppressing the higher resonant frequencies. An additional input of the comparing or comparison device SIVp, of the same sense as the actual value, is carried to the previously mentioned controller input ED intended for dynamic adjustments of desired values, whereas one channel of the correction input EK is connected to an input of the device $SIV_p$ comparing desired values with actual values and being opposite in sense to the actual value. One limit device or limiter $B_p$ located following the comparing device $SIV_p$ is set in accordance with the control limits corresponding to closing safety (bias) and maximum value setting. Inasmuch as the output quantity of a controller comprising an integrating part can exceed the aforementioned control limits upon opening its control circuit, which would lead to a strongly delayed intervention when closing the circuit, provision is made to detect reaching the control limits by means of two associated limit switches Gs1 and Gs2, connected on their input side to the input and output of the limiter Bp by way of differencing elements (i.e. summing elements with opposed inputs) and on their output side control, within the control range, with corresponding inputs Ers1 and Ers2 of the comparing device $SIV_p$ for reference and actual values, in the sense of a feedback.

During the above described assumption of command by the supply pressure control device RP the bypass valve system BV is completely closed, as a result of the action of the differencing control device for the rate of steam flow. The control valve system carries now the entire rate of steam flow, the supply pressure controller commanding the turbine, in particular under conditions of maximum utilization of the quantity of steam available from the reactor while maintaining the required supply pressure.

In order to guarantee a safe transition between the command of the control valve system by the rpm-power output controller and its command by the supply pressure controller and to avoid undefined switching conditions as well as a switching back and forth in the transition range, provision is made to bring the output AnP of the rpm-power output control device RnP by means of a supplemental signal transmitter ZS to a value larger by a predetermined amount, e.g. by 10%, than the output quantity of the supply pressure controller, as soon as two of the three channels of the supply pressure control device have passed through the minimum value selection within the control and switching device RVMin. For this purpose, there is provided in the control and switching device RVMin an output ARp1 of the already mentioned detector DAR, which controls by way of the already mentioned control circuit S1, in particular, by way of a switching stage S2 contained therein, a switch S20, by way of a corresponding control input ES20, for the purpose of activating the supplemental signal transmitter ZS. This high-value control of the rpm-power output control device RnP guarantees that all channels of the supply pressure control device RP now pass through the minimum value selection and that the supply pressure control device completely assumes command of the control valve system without any uncertainty range. Then the changeover switch S10 is switched over by way of the already mentioned output ARp of the detector DAR, as explained, by way of the control input ES10, and at the same time the input EnP of the comparing and switching device RVMin is switched over to the substitute signal transmitter ES.

In conclusion it may be said, that the activation of the supplemental signal transmitter ZS in dependence upon the output quantity of the rpm-power output control device RnP being larger than another control quantity, in the particular example cited, larger than a part of the output quantities of the multiple-channel supply pressure control device, results in a safe takeover of command over the control valve system by the substitute control quantity or by the totality of the multiple-channel arrangement of the supply pressure control device. The consequence of the subsequent switchover of the minimum value selector input associated with the rpm-power output control device to a supplemental signal transmitter is, that the rpm-power output control device remains inoperative during normal or full load operation with the command of the control valve system being performed by the supply pressure control device, so that it cannot intervene unnecessarily or erroneously in the minimum value selection in case of any disturbances. The availability of the entire control apparatus is thereby improved. In addition, through the possibility of renewed intervention, in conjunction with the mere standby function of the rpm-power output control device during normal operation with dominant supply pressure control device, the single-channel construction of the rpm-power output control device is facilitated and the switching effort reduced.

Figure 6:
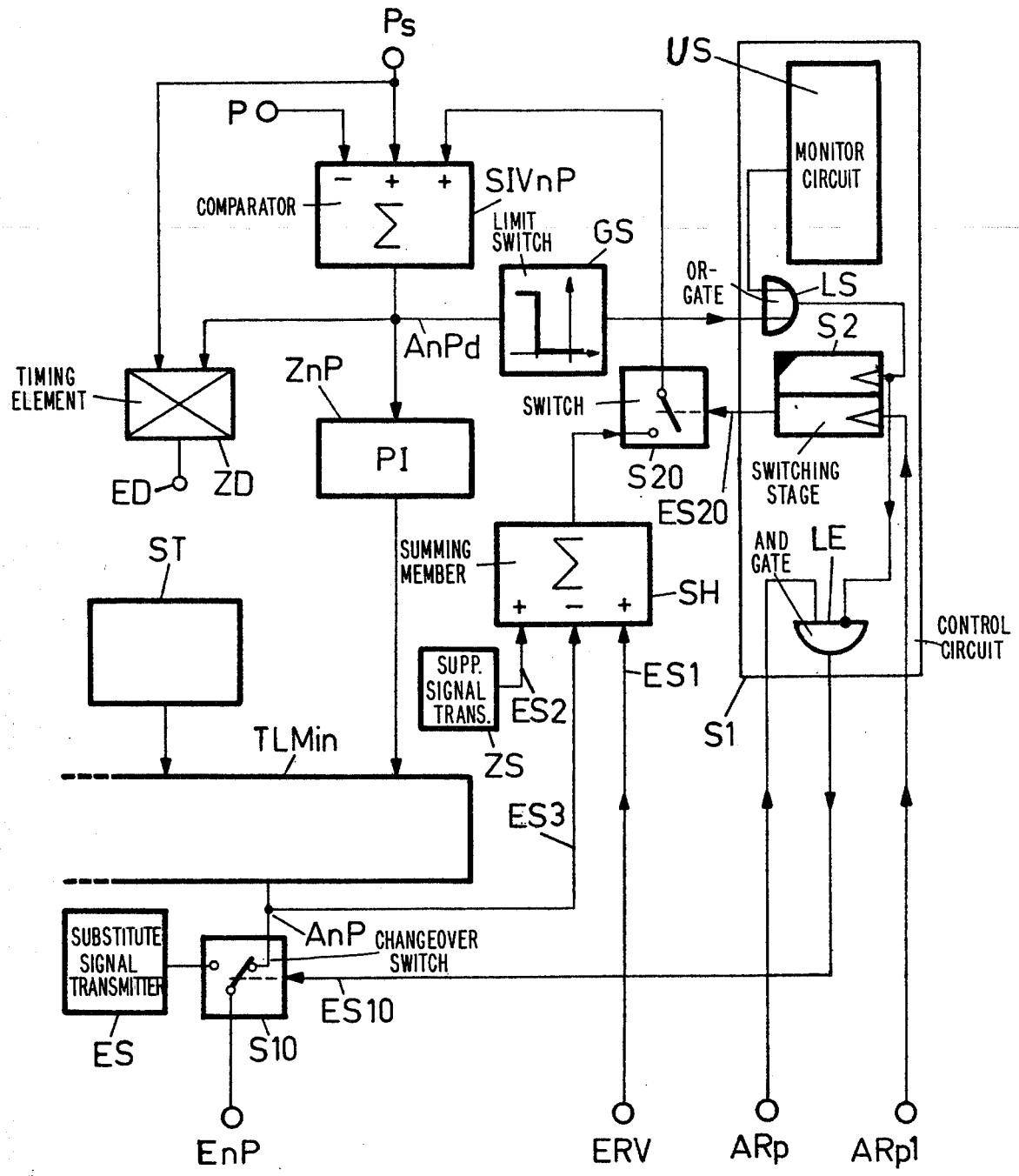
FIG. 6 is a functional diagram of the power output control portion of the rpm-power output control device of FIG. 1.

In the embodiment according to FIG. 6 the supplemental signal transmitter ZS acts upon the rpm-power output control device by way of an auxiliary control circuit, which connects the output AnP, by way of a summing member SH, with the input of the comparison device SIVnP for comparing reference or desired values with actual values, namely, in dependence upon the closure of the switch S20. A change of sign occurs at the related input ES3 of said summing member SH, so that the resulting reactive effect of the output AnP on the comparison device SIVnP for comparing reference or desired values with actual values is of the same sense as the actual value P of the power output. The opening of the rpm-power output control circuit by the minimum value selection is thus artificially compensated, for the rpm-power output controller by the auxiliary control circuit, so that the controller output fails to run up to the limits of its control range in spite of its integrating portion, but instead assumes an apparent state of equilibrium. However, this state is determined by the output ERV of the minimum value selector and the supplemental signal transmitter ZS, by way of the inputs ES1 and ES2 of the summing member SH, said inputs acting in the same sense, but in opposite sense with respect to the input ES3. With this input connection of the summing member SH, the output quantity of the rpm-power output control device is brought to a value, which is larger than the output quantity at the output ERV of the minimum value selector, by the amount of the supplemental signal. At the moment of switching-in the auxiliary control circuit by way of switch S20, i.e. upon takeover of command by two of the three supply pressure control channels, for example, the output quantity at the output ERV corresponds to an average value of the output quantities of the pressure control channels already in command and the output quantity of the rpm-power output control device. Said average value thus lies in all cases within the spread of all supply pressure controller channels, so that the now ensuing high-value control of the output quantity of the rpm-power output control device transgresses in any case the largest supply pressure controller channel output. The output AnP then remains adjusted at an overincreased value suitably set within the control range of the rpm power output control device RnP. The auxiliary control circuit thus possesses a double function, namely that of a rapid sweeping control through the transition range between the two control devices and that of maintaining a control condition for the rpm-power output control device, suitable for rapid renewed intervening.

The switching-on of the auxiliary control circuit including the supplemental signal transmitter and the substitute signal transmitter occurs, according to FIG. 6, by way of the outputs ARp and ARp1 of the detector DAR within the comparing and switching device RVMin, the output ARp1 supplying a switching command upon takeover of control by a predetermined partial number of controller units of the multiple channel supply pressure control device RP, and output ARp supplying a switching command upon complete takeover of control by the supply pressure control device. The first-mentioned switching command arrives, as previously mentioned, at the switching stage S2, whereas the last mentioned switching command blocks an AND-circuit or gate LE and effects the changeover by way of the control input ES10 of the changeover switch S10. In case of the cited example, the switching-on of the supplemental signal transmitter ZS and the substitute signal transmitter ES is associated with their uncoupling from their common detector DAR; however, a mere application of the supplemental signal transmission, with auxiliary control circuit or direct control, is also a possibility, and the high-value or run-up control, with or without feedback, of the output of the rpm-power output control device again ensuring for satisfactory blocking of unnecessary renewed interventions by way of the minimum value selector. On the other hand, the substitute signal transmission may be applied under circumstances by itself, as long as a sweep-through control, without fluctuations, of the transition range of the control valve regulation by the two control devices is guaranteed in some other way.

In certain operational cases the rpm-power output device must have the possibility of renewed intervention into the control of the control valve. For this purpose, the changeover switches S10 and S20 are switched back, namely together, by way of the output of an OR-circuit or gate LS within the control circuit S1 (see FIG. 6), which disjunctively transmits various possible tripping signals for the changeover and resets the switching stage S2 to open the auxiliary control circuit with supplemental signal transmitter ZS, and supplies a changeover command to the control input ES10 of the changeover switch S10 by way of the inverse input of the AND-circuit LE.

A first possibility of the renewed intervention by the rpm-power output control device in dependence upon a transgression of a limit value of the control deviation (desired or reference value minus actual value) of the rpm-power output control device is indicated in FIG. 6 by a limit switch GS connected to the output AnPd of the device for comparing reference with actual values. If, as a result, the arising instantaneous control deviation falls short of a negative limit value, to be set taking into consideration the supplemental signal, i.e. when the actual value of the power output is correspondingly overincreased, then the output of the rpm-power output control device is brought back, by opening the auxiliary control circuit, to a value, dependent only on the real control deviation, and is reactivated in the minimum value selection. Through this dependence of the effective desired value of power output on rotational speed, said changeover may also occur as a result of a corresponding overincrease of rotational speed or frequency in the load circuit of the turbo-generator.

Figure 7:
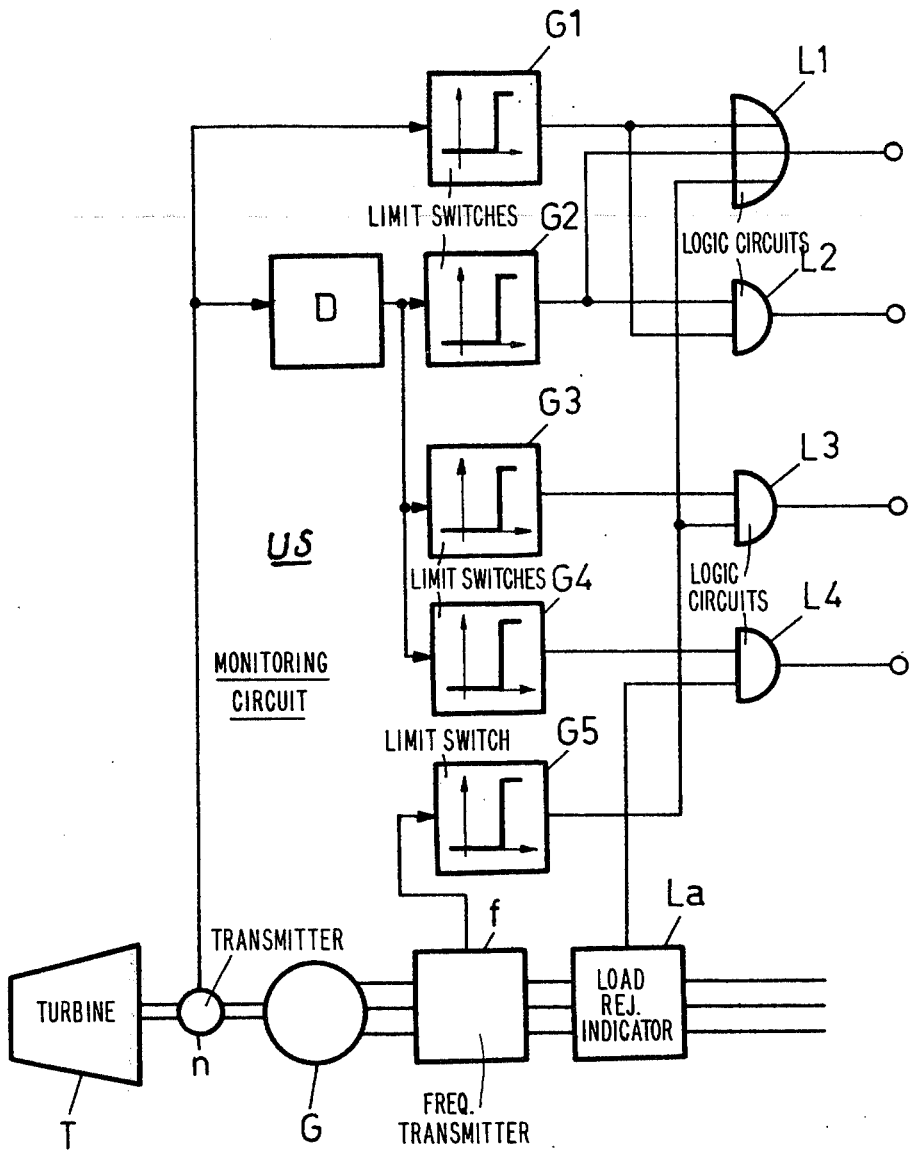
FIG. 7 is a diagram of a disturbance type changeover device for the rpm-power output control device of FIG. 1.

Other changeover criteria can be activated by a monitoring circuit US by way of the OR-circuit LS. An exemplary embodiment of a monitoring circuit of this kind is shown in FIG. 7.

The measuring members of said circuit comprise a transmitter n for the turbine rpm, a frequency transmitter f in the load circuit of the turbo-generator and a load rejection indicating device La. The actual monitoring of the various measured values is performed by means of the limit switches G1 through G5, the outputs of which are combined in various combinations by way of the logic circuits L1 through L4.

The disjunctive logic circuit L1 makes possible for triggering to occur upon transgression of the limit value of the rpm itself, by way of limit switch G1, of the rotational acceleration, by way of a differencing member D with limit switch G2, or of the frequency, by way of limit switch G5. The conjunctive logic circuit L2 triggers the changeover in dependence upon a simultaneous transgression of the limit values of the rotational acceleration and of the rpm itself, whereas the similarly conjunctive logic circuits L3 and L4 trigger the changeover at the simultaneous transgression of the limit values of the rotational acceleration and of the frequency, or at simultaneous load rejection. All these triggering criteria have in common the setting-in of an operational or disturbance condition, which acts toward an overincrease of the rotational speed.

The embodiment comprising combined substitute and supplemental signal transmission for the transfer of command, provides that the switching-back of the supplemental signal transmitter be coupled with that of the substitute signal transmitter. It is understood, that when applying the two transmitters separately, which was mentioned as being fundamentally possible, it is necessary to employ correspondingly separate triggering procedures for the switch-back.

With reference to FIG. 6 it is to be added, that in the example cited, the dynamic time member ZD is constructed as a multiplying member or timing element with two inputs, one of which is connected to the output AnPd of the comparison device SIVnP comparing desired or reference values with actual values and determines the correction signal already mentioned, which acts upon the supply pressure control device in opposite sense to the desired pressure value and in the same sense as the actual pressure value, in accordance with the instantaneous control deviation of the rpm-power output control device, whereas the other input causes a multiplying change of the correction signal corresponding to the desired power output value (dependent upon the rpm). From this results a particularly advantageous dynamic behaviour, the possibility being provided to purposely make the multiplying effect of the last mentioned input non-linear, so as to limit the correction signal. The already mentioned differentiating part of the transfer function is available in addition to the multiplying function.

In case of turbine quick-shutoff, the bypass valve system must be opened more rapidly than is possible by means of the reactivation of the rpm-power output control device alone. Therefore, the substitute controller output quantity transmitter Rsh is switched-on by a quick-shutoff triggering device, known per se, but not shown, by way of an input esh, which transmitter Rsh carries the substitute controller output quantity ash appearing at its output, as a result of proper design, as dominant value into the minimum value selection of the comparing and switching device TLMin, to the input EnP of the comparing and switching device RVMin, as well as by way of said minimum value selection to the output thereof, i.e. the input ER, and immediately opens the bypass valve system BV by way of the differencing control device or comparison circuit DV controlling the rate of steam flow.

For this purpose, the input EnP must naturally be switched-over from the substitute signal transmitter ES to the output AnP of the comparing and switching device TLMin. This is achieved by simultaneously transmitting the switching command from input esh to an appropriate input of the control circuit S1 of the changeover switch S10.

While there are shown and described present preferred embodiments of the invention, it is to be distinctly understood that the invention is not limited thereto, but may be otherwise variously embodied and practiced within the scope of the following claims.

Accordingly, what I claim is:

1. A method of controlling a steam turbine plant, especially a steam turbine plant drawing its steam from a boiling water reactor, comprising the steps of:

providing a supply pressure control device capable of performing a supply pressure control of the steam turbine plant and delivering a controller output quantity;

providing a rpm-power output control device capable of performing a rpm control with subordinated power output control and delivering a controller output quantity;

comparing the controller output quantity of the supply pressure control device and the controller output quantity of the rpm-power output control device;

performing a minimum value selection of the smallest one, in terms of rate of steam flow, of the controller output quantities of the control devices in order to control the rate of steam flow through the turbine at least predominantly by said smallest one of the controller output quantities of said control devices;

following a change of the control of the rate of steam flow through the turbine by the rpm-power output control device to the supply pressure control device and which change is a function of the result of the comparison between the controller output quantities of the supply pressure control device and the rpm-power output control device introducing a substitute signal of predetermined magnitude in place of the controller output quantity of the rpm-power output control device into the comparison between the controller output quantities of the supply pressure control device and the rpm-power output control device; and replacing said substitute signal by the controller output quantity of the rpm-power output control device only in the event of a drop in the power output of the turbine.

2. The method as defined in claim 1, further including the steps of:

controlling the rate of steam flow through the turbine exclusively by the smallest one, in terms of rate of steam flow, of the controller output quantities of the control devices.

3. The method as defined in claim 1, further including the steps of:

providing a bypass valve system controlled by the supply pressure control device;

generating a signal corresponding to the rate of steam flow through the turbine in an operating state encompassing at least predominant control of the rate of steam flow through the turbine by the rpm-power output control device;

comparing such generated signal with a reference value associated with an instantaneous rate of recirculated steam flow; and controlling the bypass valve system such as to yield a valve setting corresponding to the difference between the rate of steam flow through the turbine and the rate of recirculated steam flow.

4. The method as defined in claim 1, further including the steps of:

bringing the controller output quantity of the rpm-power output control device to a value determined by the actual difference between a reference value and actual value of the rpm-power output control device in the event of a disturbance during an operational state where the rate of steam flow through the turbine is controlled by the supply pressure control device.

5. The method as defined in claim 1, further including the steps of:

bringing the controller output quantity of the rpm-power output control device to a value determined by the actual difference between a reference value and an actual value when there is exceeded at least any one of a predetermined limit value of the rotational speed (rpm) or change as a function of time of the rotational speed of the turbine during an operational state in which the rate of steam flow through the turbine is controlled by the supply pressure control device.

6. The method as defined in claim 1, further including the steps of:

providing a load circuit for an electric generator coupled to the turbine;

comparing the frequency in the load circuit with a threshold value;

upon exceeding said threshold value with an operational state where the rate of steam flow through the turbine is controlled by the supply pressure control device bringing the controller output quantity of the rpm-power output control device to a value determined by the actual difference between a reference value and the actual value of the rpm-power output control device.

7. The method as defined in claim 1, further including the steps of:

providing a load circuit for an electric generator coupled to the turbine;

monitoring the load circuit for the occurrence of a load rejection;

upon occurrence of such load rejection and upon exceeding a threshold value of a change as a function of time of the rotational speed of the turbine in an operational state where the rate of steam flow through the turbine is controlled by the supply pressure control device bringing the controller output quantity of the rpm-power output control device to a value determined by the actual difference between a reference value and actual value of the rpm-power output control device.

8. The method as defined in claim 1, further including the steps of:

comparing the controller output quantity of the rpm-power output control device with at least one predetermined threshold value;

upon exceeding a predetermined threshold of an absolute value of the difference between a reference value and actual value in a direction indicative of too large actual value of power output with an operational state when the rate of steam flow through the turbine is controlled by the supply pressure control device bringing the controller output quantity of the rpm-power output control device to a value determined by the actual difference between the reference value and the actual value.

9. The method as defined in claim 1, further including the steps of:

providing a load circuit for an electric generator coupled to the turbine;

bringing the controller output quantity of the rpm-power output control device to a value determined by the actual difference between a reference value and actual value of the rpm-power signal output control device in the event of a disturbance accompanied by at least any one of exceeding a threshold value of the rotational speed of the turbine or the occurrence of load rejection by the electric generator coupled to the turbine; and introducing such value of the controller output quantity into the comparison between the controller output quantity of the supply pressure control device and the controller output quantity of the rpm-power output control device.

10. The method as defined in claim 3, further including the steps of:

introducing a substitute quick-shutoff positioning quantity into the minimum value selection in the event of quick-shutoff of the turbine;

impressing by means of the introduction of the substitute quick-shutoff positioning quantity upon an input of a control channel of the bypass valve system an opening signal of small delay by means of the comparison between the rate of steam flow through the turbine and the rate of recirculated steam flow.

11. A method of controlling a steam turbine plant, especially a steam turbine plant drawing its steam from a boiling water reactor, comprising the steps of:

providing a supply pressure control device capable of performing a supply pressure control of the steam turbine plant and delivering a controller output quantity;

providing a rpm-power output control device capable of performing a rpm control with subordinated power output control of the turbine and delivering a controlling output quantity;

comparing the controller output quantity of the supply pressure control device and the controller output quantity of the rpm-power output control device;

performing a minimum value selection of the smallest one, in terms of rate of steam flow, of the controller output quantities of the control devices in order to control the rate of steam flow through the turbine at least predominantly by said smallest one of the controller output quantities of said control devices;

following a change of the control of the rate of steam flow through the turbine by the rpm-power output control device to the supply pressure control device and which change is a function of the result of the comparison between the controller output quantities of the supply pressure control device and the rpm-power output control device increasing the controller output quantity of the rpm-power output control device to a value higher by a predetermined amount than said controller output quantity of said supply pressure control device and maintaining this increased value in the comparison between the controller output quantities of the supply pressure control device and the rpm-power output control device; and causing said increased value to again assume a value determined by the actual difference between a reference value and actual value of the rpm-power output control device only in the event of a drop in the turbine power output.

12. The method as defined in claim 11, further including the steps of:

controlling the rate of steam flow through the turbine exclusively by the smallest one, in terms of rate of steam flow, of the controller output quantities of the control devices.

13. The method as defined in claim 11, further including the steps of:

providing a bypass valve system controlled by the supply pressure control device;

generating a signal corresponding to the rate of steam flow through the turbine in an operating state encompassing at least predominant control of the rate of steam flow through the turbine by the rpm-power output control device;

comparing such generated signal with a reference value associated with an instantaneous rate of recirculated steam flow; and controlling the bypass valve system such as to yield a valve setting corresponding to the difference between the rate of steam flow through the turbine and the rate of recirculated steam flow.

14. The method as defined in claim 11, further including the steps of:

bringing the controller output quantity of the rpm-power output control device to a value determined by the actual difference between a reference value and actual value of the rpm-power output control device in the event of a disturbance during an operational state where the rate of steam flow through the turbine is controlled by the supply pressure control device.

15. The method as defined in claim 11, further including the steps of:

bringing the controller output quantity of the rpm-power output control device to a value determined by the actual difference between a reference value and an actual value when there is exceeded at least any one of a predetermined limit value of the rotational speed (rpm) or change as a function of time of the rotational speed of the turbine during an operational state in which the rate of steam flow through the turbine is controlled by the supply pressure control device.

16. The method as defined in claim 11, further including the steps of:

providing a load circuit for an electric generator coupled to the turbine;

comparing the frequency in the load circuit with a threshold value;

upon exceeding said threshold value with an operational state where the rate of steam flow through the turbine is controlled by the supply pressure control device bringing the controller output quantity of the rpm-power output control device to a value determined by the actual difference between a reference value and the actual value of the rpm-power output control device.

17. The method as defined in claim 11, further including the steps of:

providing a load circuit for an electric generator coupled to the turbine;

monitoring the load circuit for the occurrence of a load rejection;

upon occurrence of such load rejection and upon exceeding a threshold value of a change as a function of time of the rotational speed of the turbine in an operational state where the rate of steam flow through the turbine is controlled by the supply pressure control device bringing the controller output quantity of the rpm-power output control device to a value determined by the actual difference between a reference value and actual value of the rpm-power output control device.

18. The method as defined in claim 11, further including the steps of:

comparing the controller output quantity of the rpm-power output control device with at least one predetermined threshold value;

upon exceeding a predetermined threshold of an absolute value of the difference between a reference value and actual value in a direction indicative of too large actual value of power output with an operational state where the rate of steam flow through the turbine is controlled by the supply pressure control device bringing the controller output quantity of the rpm-power output control device to a value determined by the actual difference between the reference value and the actual value.

19. The method as defined in claim 11, further including the steps of:

providing a load circuit for an electric generator coupled to the turbine;

bringing the controller output quantity of the rpm-power output control device to a value determined by the actual difference between a reference value and actual value of the rpm-power output control device in the event of a disturbance accompanied by at least one of exceeding a threshold value of the rotational speed of the turbine or the occurrence of load rejection by the electric generator coupled to the turbine; and introducing such value of the controller output quantity into the comparison between the controller output quantity of the supply pressure control device and the controller output quantity of the rpm-power output control device.

20. The method as defined in claim 13, further including the steps of:

introducing a substitute quick-shutoff positioning quantity into the minimum value selection in the event of quick-shutoff of the turbine;

impressing by means of the introduction of the substitute quick-shutoff positioning quantity upon an input of a control channel of the bypass valve system an opening signal of small delay by means of the comparison between the rate of steam flow through the turbine and the rate of recirculated steam flow.

21. An apparatus for controlling a steam turbine plant, especially a steam turbine plant drawing its steam from a boiling water reactor, comprising:

a supply pressure control device capable of performing a supply pressure control of the steam turbine plant;

a bypass valve system operatively associated with the turbine of the steam turbine plant;

a control valve system operatively associated with the turbine of the steam turbine plant for controlling the rate of steam flow through the turbine;

an rpm-power output control device for the rpm-control and subordinated power output control of the steam turbine plant;

said control valve system comprising at least one control channel having an input;

a comparing and switching device having an input side with plural inputs and an output side with plural outputs;

the input of said at least one control channel of the control valve system being connected to an output of the comparing and switching device;

the input side of said comparing and switching device being connected by one of its inputs to at least one controller output of the supply pressure control device and by another one of its inputs to at least one output of the rpm-power output control device;

minimum value selection means for the control connection of the output side of the comparing and switching device at least predominantly by the smallest one, in terms of valve setting, of its input signals;

a comparison circuit having an input side and an output side;

the input side of said comparison circuit being in control connection with the supply pressure control device and with said at least one control channel of the control valve system;

said comparison circuit having an output at which there is supplied a control signal corresponding to the difference between the rate of recirculated steam flow and the rate of steam flow through the turbine;

said bypass valve system having at least one control channel connected to the output side of the comparison circuit;

a changeover switch having first and second inputs and an output;

one input of the comparing and switching device being connected with the output of the changeover switch;

the first input of the changeover switch being connected to an output of the rpm-power output control device;

a substitute signal transmitter having an output;

the second input of the changeover switch being connected to said output of said substitute signal transmitter for supplying a substitute signal of predetermined magnitude;

said changeover switch receiving a switching command upon a changeover to dominant control of the rate of steam flow through the turbine by the supply pressure control device and operatively connecting the substitute signal transmitter with the comparing and switching device.

22. The apparatus as defined in claim 21, wherein:

said changeover switch receives a switching command for connecting the rpm-power output control device with the comparing and switching device as a function of exceeding any one of a threshold value of at least the rotational speed or a change as a function of time of the rotational speed of the turbine.

23. The apparatus as defined in claim 21, wherein:

said steam turbine plant includes a load circuit having a generator coupled with the turbine; and said changeover switch receiving a switching command for connecting the rpm-power output control device with the comparing and switching device when there is exceeded a threshold value of the frequency in the load circuit of the generator coupled with the turbine.

24. The apparatus as defined in claim 21, wherein:

said steam turbine plant includes a load circuit having a generator coupled with the turbine; a limit switch responsive to exceeding of a threshold value of the change as a function of time of the rotational speed of the turbine;

a monitoring device;

means for placing the monitoring device in conjunctive control connection with the load circuit of the generator coupled with the turbine;

said changeover switch having at least one control input connected with said monitoring device;

said changeover switch when in conjunctive control connection connecting said rpm-power output control device with said comparing and switching device.

25. The apparatus as defined in claim 21, further including:

a limit switch;

said changeover switch having at least one control input;

said control input of the changeover switch being connected by means of said limit switch with a reference value-actual value difference output of the rpm-power output control device in a control connection which activates the rpm-power output control device.

26. An apparatus for controlling a steam turbine plant, especially a steam turbine plant drawing its steam from a boiling water reactor, comprising:

a supply pressure control device capable of performing a supply pressure control of the steam turbine plant;

a bypass valve system operatively associated with the turbine of the steam turbine plant;

a control valve system operatively associated with the turbine of the steam turbine plant for controlling the rate of steam flow through the turbine;

an rpm-power output control device for the rpm-control and subordinate power output control of the steam turbine plant;

said control valve system comprising at least one control channel having an input;

a comparing and switching device having an input side with plural inputs and an output side with plural outputs;

the input of said at least one control channel of the control valve system being connected to an output of the comparing and switching device;

the input side of said comparing and switching device being connected by one of its inputs to at least one controller output of the supply pressure control device and by another of its inputs to at least one output of the rpm-power output control device;

minimum value selection means for the control connection of the output side of the comparing and switching device at least predominantly with the smallest one, in terms of valve setting, of its input signals;

a comparison circuit having an input side and an output side;

the input side of said comparison circuit being in control connection with the supply pressure control device and with said at least one control channel of the control valve system;

said comparison circuit having an output at which there is supplied a control signal corresponding to the difference between the rate of recirculated steam flow and the rate of steam flow through the turbine;

said bypass valve system having at least one control channel connected to the output side of the comparison circuit;

an auxiliary control circuit in control connection with the rpm-power output control device for switching back the output of the rpm-power output control device into the comparison process between a reference value and an actual value of said rpm-power output control device when at least one other control value is smaller than the output quantity of said rpm-power output control device.

27. The apparatus as defined in claim 26, further including:

a changeover switch having at least one control input;

a limit switch;

said control input of the changeover switch being connected by means of said limit switch with an output of the rpm-power output control device which carries the difference between a reference value and actual value and in a manner activating the rpm-power output control device;

said auxiliary control circuit comprising a summing device having a first input, a second input and a third input;

the first input of the summing device being controllably connected with the supply pressure control device;

a supplemental signal transmitter;

the second input of the summing device carrying a signal of the same sign to the supplemental signal transmitter;

the third input of the summing device carrying a signal of opposite sign to an output of the rpm-power output control device;

a comparison device for comparing reference values with actual values of the rpm-power output control device; and said summing device having an output side connected with said comparison device for comparing reference values with actual values of the rpm-power output control device.

28. The apparatus as defined in claim 26, wherein:

a transfer function of the rpm-power output control device comprises an integrating part in addition to a proportional part.

29. The apparatus as defined in claim 27, further including:

switch means which upon occurrence of an operational state in the sense of an overincrease in the rotational speed of the turbine switches back the output of the rpm-power output control device to cause it to assume exclusive control by way of the difference between the reference value and the actual value of the rpm-power output control device.

30. The apparatus as defined in claim 26, further including:

switch means for inactivating the auxiliary control circuit of the rpm-power output control device when an operational state arises which tends towards an overincrease in at least any one of the rotational speed of the turbine or a change as a function of time of the rotational speed of the turbine.

31. The apparatus as defined in claim 29, wherein:

said switch means has a control input;

means for monitoring a threshold value of at least any one of the rotational speed of the turbine or the change as a function of time of the rotational speed of the turbine; and the control input of the switch means being in control connection with said monitoring means.

32. The apparatus as defined in claim 29, wherein:

said steam turbine plant includes a load circuit having a generator coupled with the turbine;

said switch means having a control input;

a threshold monitoring device for monitoring the frequency in the load circuit of the generator coupled with the turbine;

said control input of said switch means being in control connection with said monitoring means.

33. The apparatus as defined in claim 29, wherein:

said steam turbine plant includes a load circuit having a generator coupled with the turbine;

said switch means having a control input;

monitoring means responsive to exceeding a threshold value of the change as a function of time of the rotational speed of the turbine;

monitoring means for monitoring load rejection;

said switch means having a control input; and means for connecting the control input of the switch means in conjunctive control connection with the monitoring means responsive to exceeding a threshold value of the change as a function of time of the rotational speed of the turbine and with the monitoring means for monitoring the load rejection.

34. The apparatus as defined in claim 29, wherein:

said switch means has a control input;

a limit switch;

said control input of said switch means being connected by means of said limit switch with an output of the rpm-power output control device which carries a signal corresponding to the difference between the reference value and the actual value of the rpm-power output control device.

35. The apparatus as defined in claim 34, wherein:

said supply pressure control device is structured at least in sections having multiple channels.

36. The apparatus as defined in claim 35, wherein:

said multiple channels comprise three channels.

37. The apparatus as defined in claim 35, wherein:

said supply pressure control device possesses a transfer function comprising an integrating part.

38. The apparatus as defined in claim 37, wherein:

said transfer function is a PID-transfer function.

39. The apparatus as defined in claim 35, further including:

feedback connection means provided for the individual channels of the supply pressure control device;

said feedback connection means comprising a differencing device having inputs;

an averaging device;

said inputs of said differencing device being connected with said averaging device and with output means carrying positioning quantities or difference quantities between reference values and actual values of the supply pressure control device.

40. The apparatus as defined in claim 35, further including:

a limit device connected to an output of the supply pressure control device;

means providing a control connection of said limit device by means of at least one feedback connection means with at least one reset input carrying the difference between reference values and actual values.

41. The apparatus as defined in claim 40, wherein:

the supply pressure control device comprises an input for adjusting reference values;

a dynamic timing member possessing a differentiating transfer function;

said dynamic timing member connecting said input of the supply pressure control device with an output of the rpm-power output control device carrying a positioning quantity or a difference between a reference value and actual value.

* * * * *